United States Patent [19]

Carter

[11] Patent Number: 4,584,731

[45] Date of Patent: Apr. 29, 1986

[54] BED-RIDDEN PATIENT SUPPORT

[76] Inventor: Dennis L. Carter, 726 E. Ewing Ave., South Bend, Ind. 46613

[21] Appl. No.: 649,078

[22] Filed: Sep. 10, 1984

[51] Int. Cl.[4] ..... A47C 20/04

[52] U.S. Cl. ..... 5/431; 5/71; 5/443; 5/507; 4/522; 4/523; 108/49

[58] Field of Search ..... 5/431, 432, 433, 436, 5/443, 81 R, 503, 508, 71, 77, 507; 4/522, 523, 254; 269/328; 108/49

[56] References Cited

U.S. PATENT DOCUMENTS

| | | | |
|---|---|---|---|
| 677,672 | 7/1901 | Libby | 5/508 |
| 3,005,212 | 10/1961 | Barnhill | 5/431 |
| 3,167,790 | 2/1965 | Hickey | 5/507 |
| 4,373,222 | 2/1983 | Wolfe et al. | 269/328 |

FOREIGN PATENT DOCUMENTS

| | | | |
|---|---|---|---|
| 2946987 | 6/1981 | Fed. Rep. of Germany | 269/328 |

*Primary Examiner*—Alexander Grosz
*Attorney, Agent, or Firm*—James D. Hall

[57] ABSTRACT

A two-piece patient support having height adjustable legs. One piece of the support includes hinged sections for ease in elevating the patient's head.

5 Claims, 5 Drawing Figures

BED-RIDDEN PATIENT SUPPORT

SUMMARY OF THE INVENTION

This invention relates to an adjustable support and will have special application to a multiple piece support for caring for bed-ridden patients.

Medical and cosmetic care for a bed-ridden person is often difficult due to the awkward stance a physician must take in leaning over the edge of the bed to work on the patient's body. This problem is especially acute for dentists and barbers.

This invention includes a two-part support adapted to overlie a bed at its opposite sides. The support includes adjustable legs which position the support parts above the floor. By turning the patient approximately 90° such that the patient's head and feet are supported by the respective support parts, then adjusting the leg lengths, a dentist or other technician may comfortably perform services on the patient.

Accordingly, it is an object of this invention to provide a treatment support which is for bed-ridden patients.

Another object of this invention is to provide for a bed-ridden patient support which is adjustable to accomodate treatment of the patient.

Another object of this invention is to provide for a method of administering health and cosmetic care to a bed-ridden person.

Other objects of this invention will become apparent upon a reading of the following specification.

BRIEF DESCRIPTION OF THE DRAWINGS

A preferred embodiment has been chosen to illustrate the principles of the invention wherein.

DESCRIPTION OF THE PREFERRED EMBODIMENT

Figure 1:
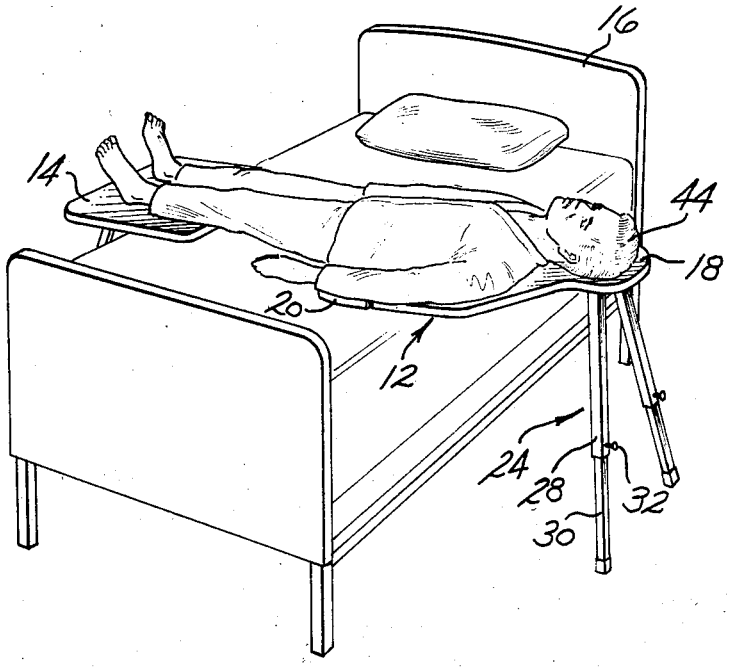
FIG. 1 is a perspective view of the patient support shown in use on a bed supporting a patient.
Figure 2:
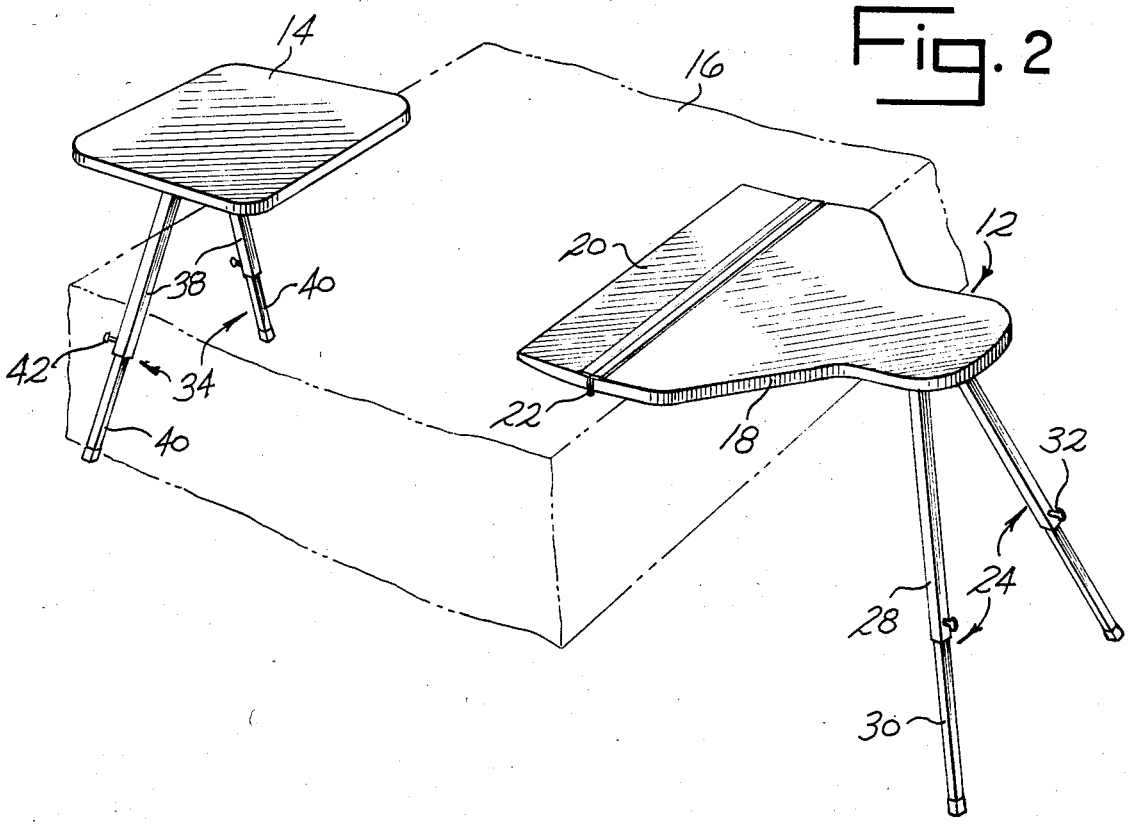
FIG. 2 is a perspective view of the patient support.
Figure 3:
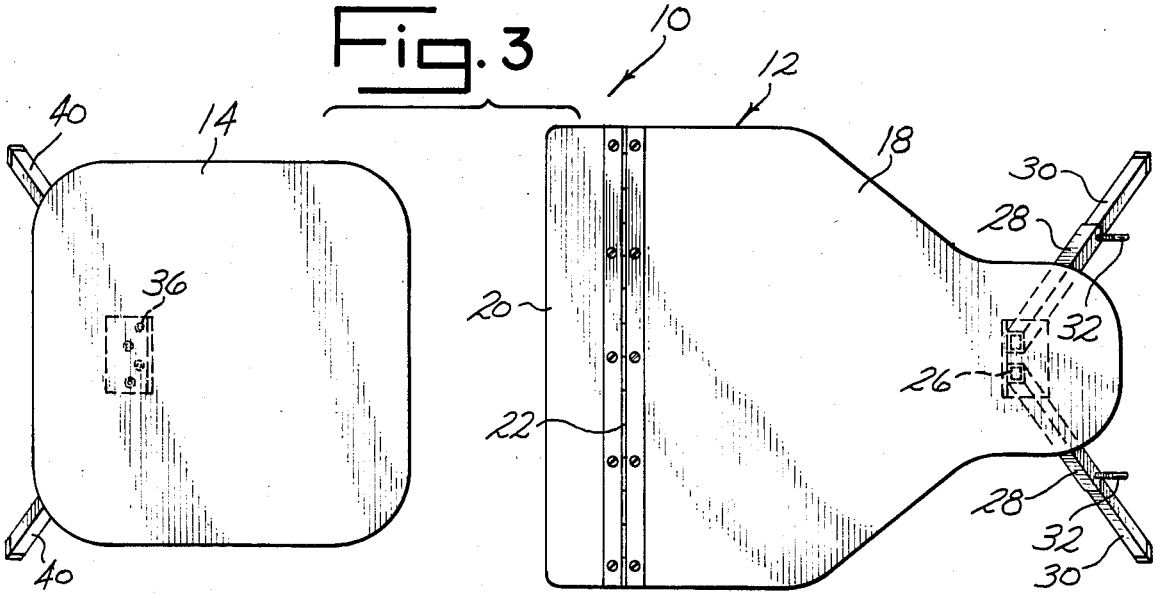
FIG. 3 is a top plan view of the patient support.
Figure 4:
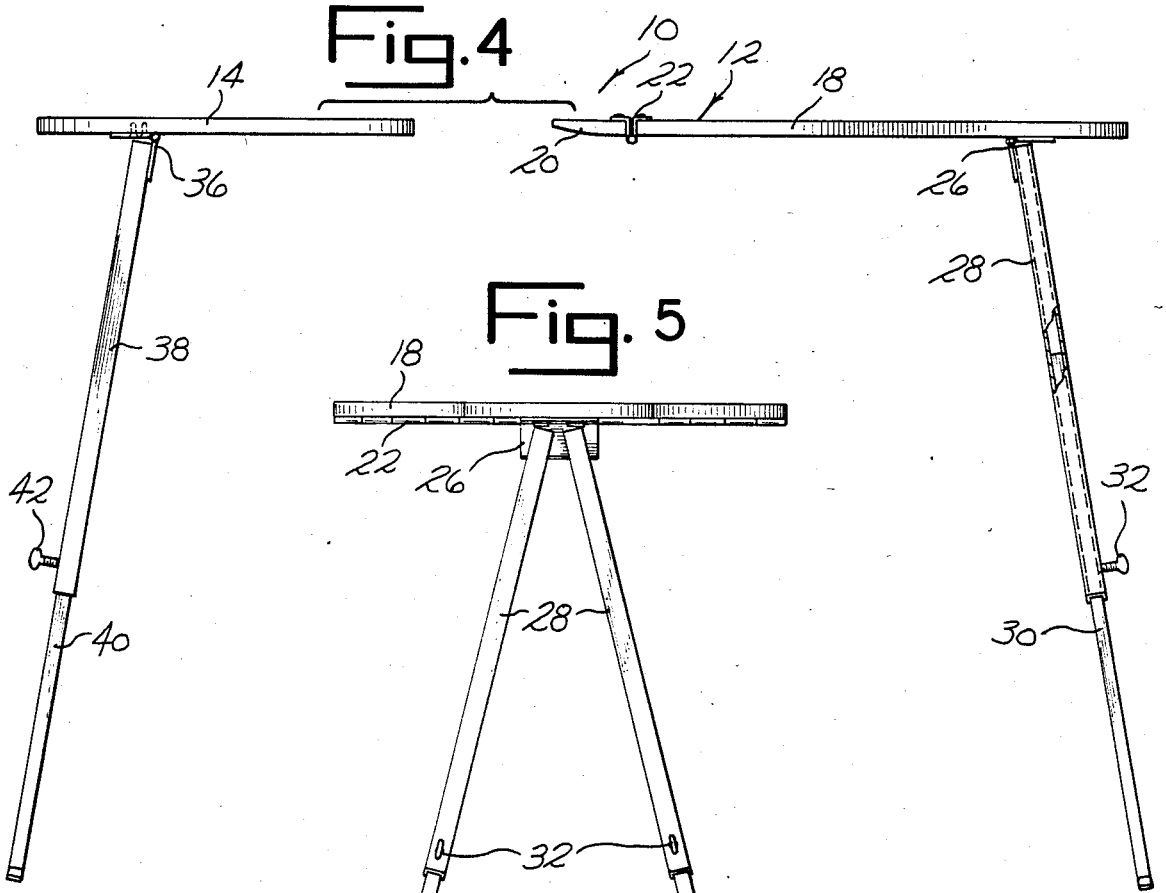
FIG. 4 is a side elevational view of the patient support.
Figure 5:
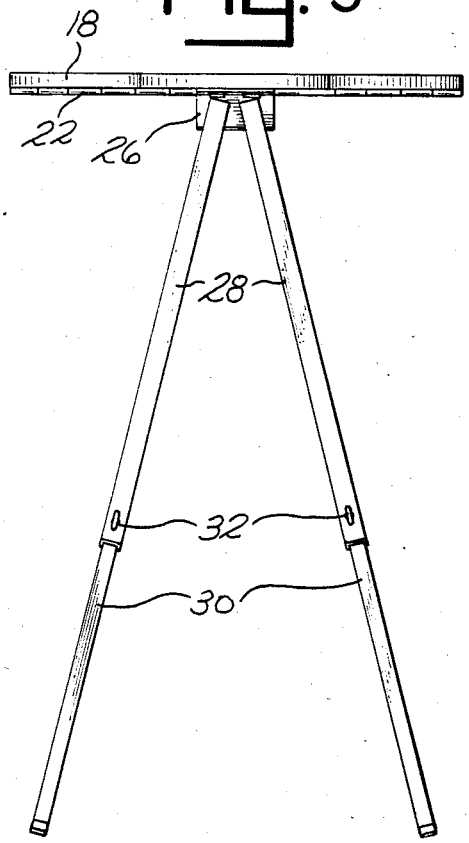
FIG. 5 is an end view of the patient support.

The preferred embodiment herein described is not intended to be exhaustive or to limit the invention to the precise form disclosed. It is chosen and described to explain the principles of the invention, and its application and practical use to enable others skilled in the art to utilize the invention.

The patient support 10 shown in the drawings includes a head and torso rest or part 12 and a foot rest or part 14 which are adapted for use with a bed 16. Rest 12 includes a head section 18 and a torso section 20 separated by a hinge 22. A pair of legs 24 are pivotally connected to head section 18 by a bracket 26. Each leg 24 includes telescoping tubes 28,30 and a set screw 32 for securing the tubes at an adjusted length. A pair of legs 34, similar to legs 24, are pivotally connected to rest 14 by a bracket 36. Each leg 34 include telescoping tube 38,40 and a set screw 42.

Support 10 is utilized as follows. With patient 44 lying in bed 16, head and torso rest 12 and foot rest 14 are positioned atop the sides of the bed at a right angle to the head of the bed. Legs 24,34 are adjusted to the proper height by adjusting telescoping tubes 28,30 and 38,40, until the correct height is reached. Set screws 32,42 are then turned to lock the legs in position. Patient 44 is then pivoted upon bed 16 until his head rests upon head section 18 and his feet rest upon foot rest 14. Final adjustments in height of support 10 may then be made by loosening set screws 32,42 re-setting legs 24,34 and tightening the set screws.

When the doctor, dentist, or other servicing individual is finished with patient 44, the patient is returned to his normal position upon bed 16 and legs 24,34 are collapsed for ease in transporting the support to the next patient.

It is to be understood that the scope of the invention is not limited to the above description, but may be modified within the scope of the appended claims.

I claim:

1. A support for a patient confined to a bed, said support comprising a foot rest adapted to adjacently overlie a side of said bed, leg means extending from said foot rest for supporting said foot rest atop said bed, a torso rest adapted to adjacently overlie a side of said bed opposite said foot rest, leg means extending from said torso rest for supporting said torso rest atop said bed, said foot rest and torso rest constituting means for supporting said patient when turned ninety degrees in a horizontal plane upon said bed, said torso rest including first and second sections joined together by hinge.

2. The patient support of claim 1 wherein said leg means includes a pair of telescoping tubes pivotally connected at one end to said foot rest and torso rest.

3. The patient support of claim 2 and means for adjusting the length of said telescoping tubes.

4. A method of positioning a bed-ridden patient for the purpose of administering services thereto comprising:

a. positioning a first support member having legs upon the floor supported bed of the patient at one side of the bed with said legs extending to the floor;

b. positioning a second support member having hinged first and second sections and legs upon said patient bed at an opposite side of the bed with said last mentioned legs extending to the floor; and c. turning said patient upon said bed in a generally horizontal plane approximately 90° degrees until the lower body of the patient is supported atop said first support member and the upper body of the patient is supported atop said second support member.

5. The method of claim 4 and including the step of adjusting the height of at least one of said patient support members relative to said floor by adjusting the length of the legs of said one support member.

* * * * *